US008499500B2

(12) United States Patent
Lamke

(10) Patent No.: US 8,499,500 B2
(45) Date of Patent: Aug. 6, 2013

(54) RECREATIONAL STRUCTURE HAVING AN INFLATABLE SUPPORT ASSEMBLY

(75) Inventor: Samuel Lamke, Washington, MO (US)

(73) Assignee: HKD International (HK) Limited, North Point (HK)

( * ) Notice: Subject to any disclaimer, the term of this patent is extended or adjusted under 35 U.S.C. 154(b) by 0 days.

(21) Appl. No.: 13/461,421

(22) Filed: May 1, 2012

(65) Prior Publication Data

US 2012/0273018 A1 Nov. 1, 2012

Related U.S. Application Data

(63) Continuation of application No. 12/373,430, filed as application No. PCT/US2007/073389 on Jul. 12, 2007, now Pat. No. 8,166,711.

(60) Provisional application No. 60/830,175, filed on Jul. 12, 2006.

(51) Int. Cl.
*E04B 1/34* (2006.01)

(52) U.S. Cl.
USPC ..... 52/2.18; 52/2.17; 52/2.23

(58) Field of Classification Search
USPC ..... 52/2.13, 2.17, 2.18, 2.24, 2.23; 135/20.2, 135/125, 135
See application file for complete search history.

(56) References Cited

U.S. PATENT DOCUMENTS

| | | | |
|---|---|---|---|
| 4,197,681 | A | 4/1980 | Holcombe |
| 4,876,829 | A | 10/1989 | Mattick |
| 5,005,322 | A | 4/1991 | Mattick et al. |
| 5,007,212 | A | 4/1991 | Fritts et al. |
| 5,205,086 | A | 4/1993 | Heim |
| 5,893,237 | A | 4/1999 | Ryon et al. |
| 6,260,306 | B1 | 7/2001 | Swetish et al. |
| 6,263,617 | B1 | 7/2001 | Turcot et al. |
| 6,463,699 | B1 | 10/2002 | Bailey et al. |
| 7,552,555 | B2 | 6/2009 | Pellecuer et al. |
| 2002/0083653 | A1 | 7/2002 | Hilbert |

FOREIGN PATENT DOCUMENTS

| | | |
|---|---|---|
| GB | 1518011 | 11/1976 |
| GB | 2104934 | 6/1982 |

*Primary Examiner* — William Gilbert
*Assistant Examiner* — Gisele Ford
(74) *Attorney, Agent, or Firm* — Polster, Lieder, Woodruff & Lucchesi, LC

(57) ABSTRACT

A shelter including a support assembly having a plurality of inflatable supports each having an elongated tube body and defining at least two separate longitudinal passages pneumatically separated by a bladder, wherein the tube bodies of each support is connected to the tube body of one or more of the other supports and wherein each of the passages of the each support is pneumatically connected to each of the passages of the other supports, and wherein the supports are spaced circumferentially apart as legs of the support assembly for forming a perimeter of the shelter, and a single port pneumatically coupled to only one of the supports, the port configured for passing air between an external pneumatic vessel and the support to which the port is coupled and a canopy including a plurality of wall panels, the wall panels being configured for being suspended from the support assembly.

21 Claims, 5 Drawing Sheets

RECREATIONAL STRUCTURE HAVING AN INFLATABLE SUPPORT ASSEMBLY

CROSS-REFERENCE TO RELATED APPLICATIONS

This application is a continuation of U.S. patent application Ser. No. 12/373,430 filed on Aug. 14, 2009 and as issued as U.S. Pat. No. 8,166,711 on May 1, 2012; which was a National Stage under 35 USC Section 371 of PCT Application No. PCT/US2007/073389 as filed on Jul. 12, 2007, which claimed the benefit of U.S. Provisional Application No. 60/830,175, filed on Jul. 12, 2006. The disclosures of the above application are incorporated herein by reference.

FIELD

The present disclosure relates to recreational structures, and more specifically, to an inflatable support systems and methods for supporting recreational shelters including lightweight shelters such as awnings and tents.

BACKGROUND

The statements in this section merely provide background information related to the present disclosure and may not constitute prior art.

Most commercially available tents commonly utilize semi rigid segmented pole constructions, which support the tent in its erected position. Commonly, erecting prior art tents are at best time consuming and at worst frustrating when the tent erection is required to be done quickly. The disclosure presented hereinafter describes illustrative embodiments of easy to erect tent structures using inflatable supports for supporting the tent.

Existing tent structures include inflatable support structures, which generally are intended to be self-erecting. These include U.S. Pat. Nos. 6,263,617, 5,205,086, 4,876,829 and 5,005,322 along with the references cited with respect to those patents. While the prior art constructions works for their intended purposes, problems have been encountered with their use. In particular, the air support structures or tubes that are used to support the tent material often is difficult to replace. In addition, the prior art generally relied upon individual tubes for the tent support. Even when the constructions provided for simultaneous inflation of the tubes, existing solutions are unrealistically concerned with individual tube replacement because of the complicated interconnection tube and the associated tent material.

SUMMARY

The inventor hereof has succeeded at designing an improved air inflation structure. The inventor has found that utilization of a single support assembly having a plurality of tube bodies pneumatically connected has advantages over the prior art. Additionally, in some embodiments, the tube bodies of the supports can be easily attachable to the canopy for enabling a simplified structure, easy removal and replacement of support tube bodies, for example if and when they become damaged and for expedited deflation and inflation of the tubes themselves.

According to one aspect, a support assembly for a canopy of a shelter including a first inflatable support having an elongated tube body and defining at least two separate longitudinal passages pneumatically separated by a bladder and a second inflatable support having an elongated tube body and defining at least two separate longitudinal passages pneumatically separated by a bladder. The tube body of the second support is connected to the tube body of the first support and wherein each of the passages of the second support is pneumatically connected to each of the passages of the first support. A port is pneumatically coupled to one of the first and second supports and is configured for passing air between an external pneumatic vessel and the support to which the port is coupled.

According to another aspect, a shelter including a canopy having a plurality of wall panels and means for supporting the canopy to form the shelter. The means for supporting including a plurality of inflatable supports each having an elongated tube body and means for forming multiple longitudinal passages within each inflatable support and for pneumatically connecting each of the passages to the each of the passages of the other supports and means for passing air between an external pneumatic vessel and the passages of the support assembly. The shelter also includes means for securing the canopy to the means for support the canopy.

According to yet another aspect, a shelter including a support assembly having a plurality of inflatable supports each having an elongated tube body and defining at least two separate longitudinal passages pneumatically separated by a bladder, wherein the tube bodies of each support is connected to the tube body of one or more of the other supports and wherein each of the passages of the each support is pneumatically connected to each of the passages of the other supports, and wherein the supports are spaced circumferentially apart as legs of the support assembly for forming a perimeter of the shelter, and a single port pneumatically coupled to only one of the supports, the port configured for passing air between an external pneumatic vessel and the support to which the port is coupled and a canopy including a plurality of wall panels, the wall panels being configured for being suspended from the support assembly.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses.

Figure 12:
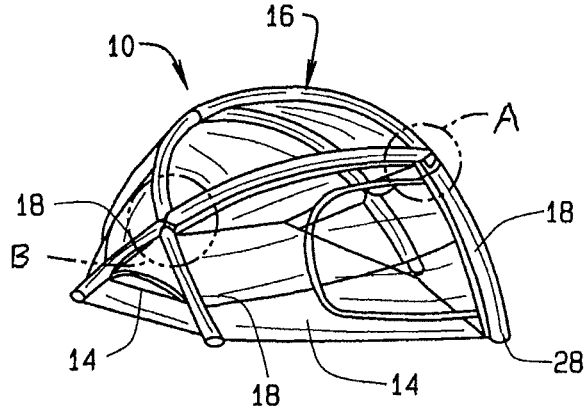
FIG. 12 is a view in perspective of another exemplary embodiment of a support structure.
Figure 13:
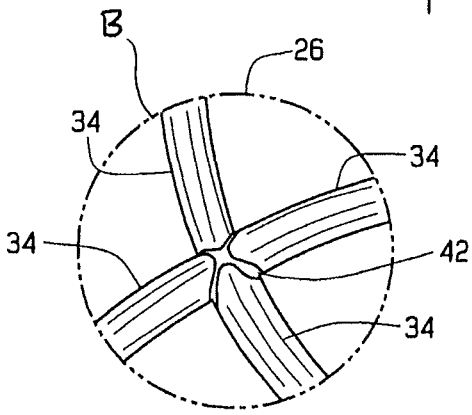
FIG. 13 is a view in perspective, partially broken away, illustrating the interconnection between a first set of side positioned tubes of the support structure of FIG. 12.
Figure 14:
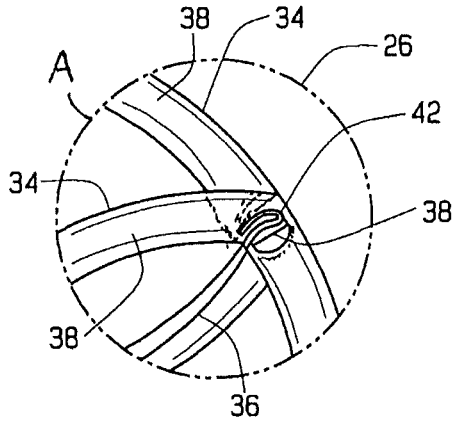
FIG. 14 is a view in perspective, partially broken away, illustrating the interconnection between a second set of side positioned tubes of the support structure of FIG. 12.
Figure 15:
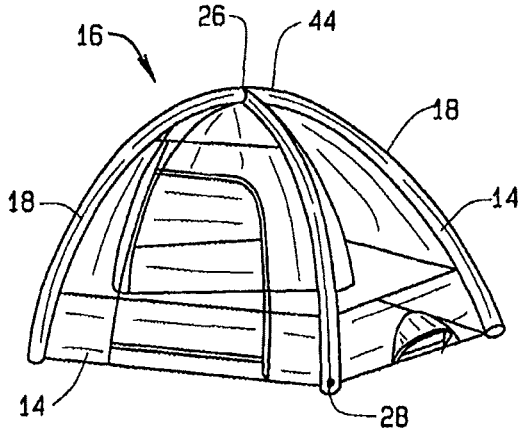
FIG. 15 is a view in perspective of yet another exemplary embodiment of a support structure.
Figure 16:
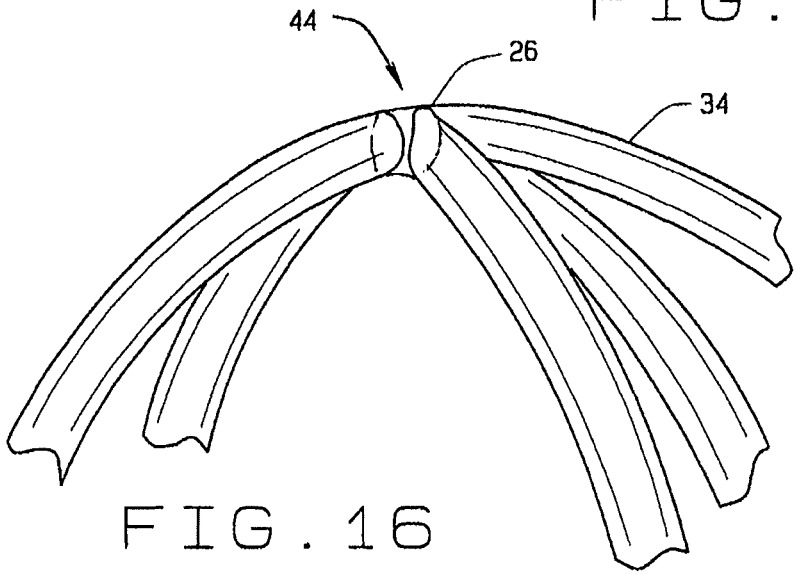
FIG. 16 is a view in perspective, partially broken away, illustrating the interconnection of a five-leg tube support structure according to one embodiment of the support structure of FIG. 15.

The present disclosure address shelters and support assemblies therefore. One exemplary embodiment of a shelter 10 is provided in FIGS. 1-4. As shown, the shelter 10 includes a canopy 12 having a plurality of sidewalls 14. The canopy 12 is supported by a support assembly 16 having a plurality of inflatable supports 18. The number of supports 18 is unlimited, but in many embodiments including between three and eight, and as shown in the Figures includes 4 supports (FIGS. 1-9, 5 supports (FIG. 15-17, or 6 supports (FIGS. 12-14).

Figure 1:
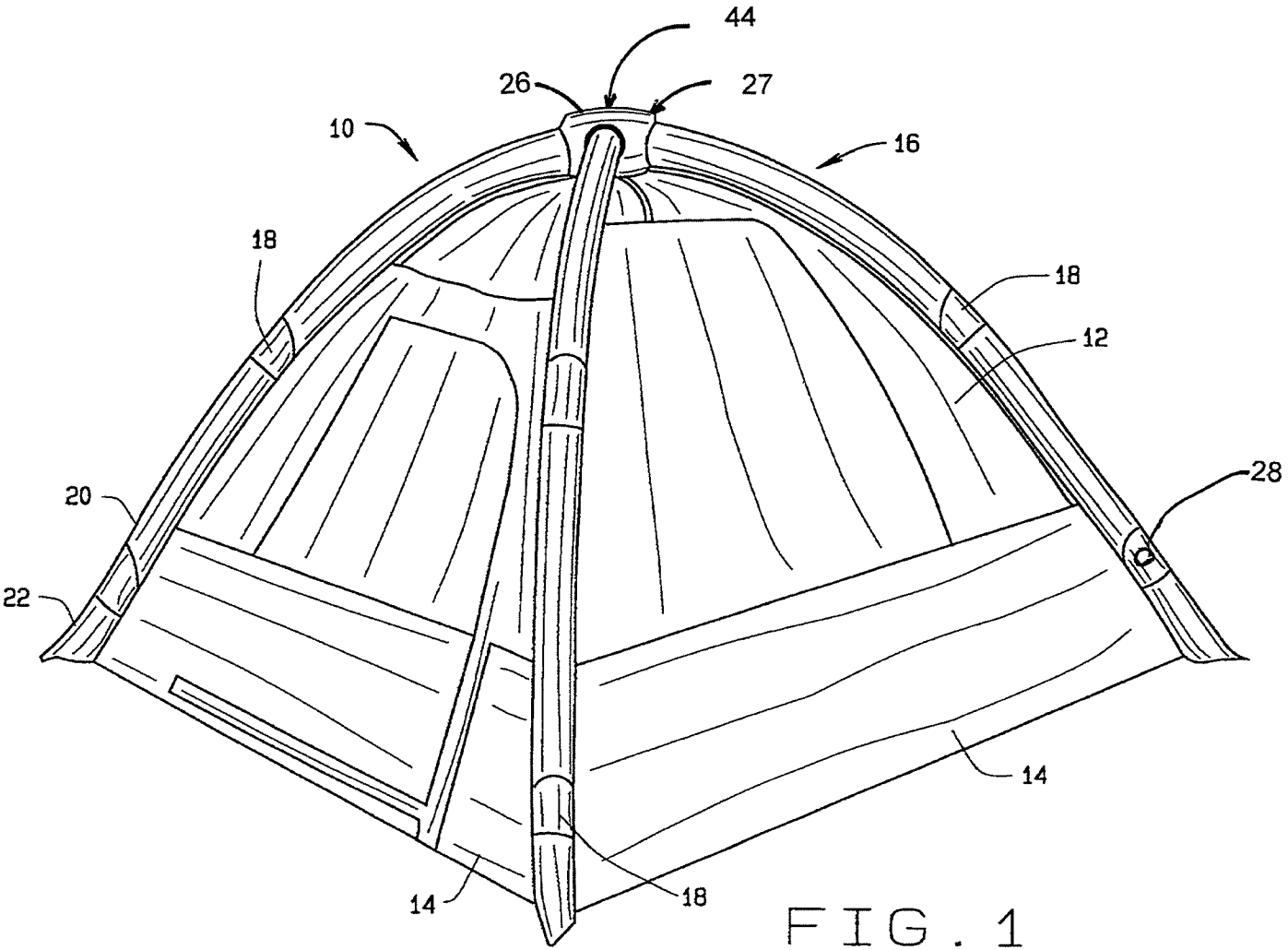
FIG. 1 is a perspective view of one illustrative embodiment of tent having an exemplary dome construction.
Figure 2:
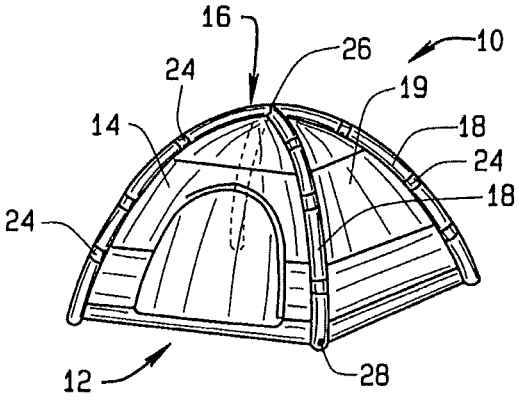
FIG. 2 is a view in perspective of an inflatable support structure for shelters according to one exemplary embodiment.
Figure 3:
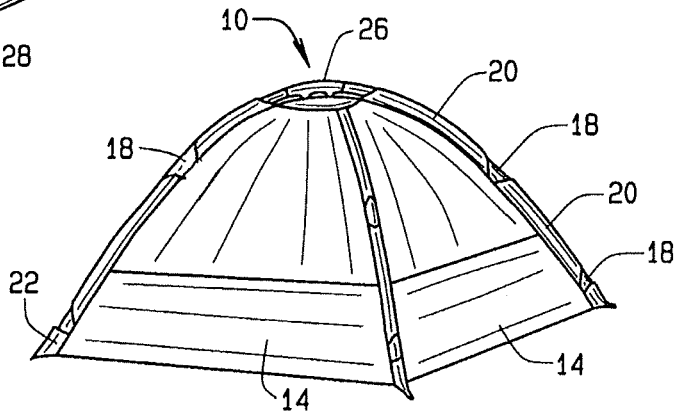
FIG. 3 is a view in perspective, illustrating one exemplary rear view of the exemplary embodiment of FIGS. 1 and 2.
Figure 5:
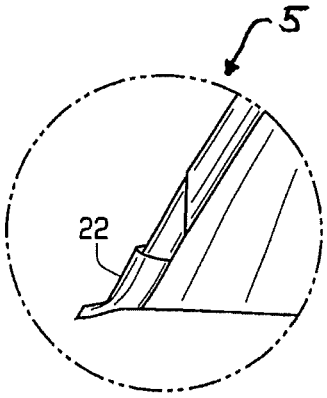
FIG. 5 is a close up view in perspective of the coupling between a single tube body of a support structure and a canopy and weather cover according to some exemplary embodiments.
Figure 4:
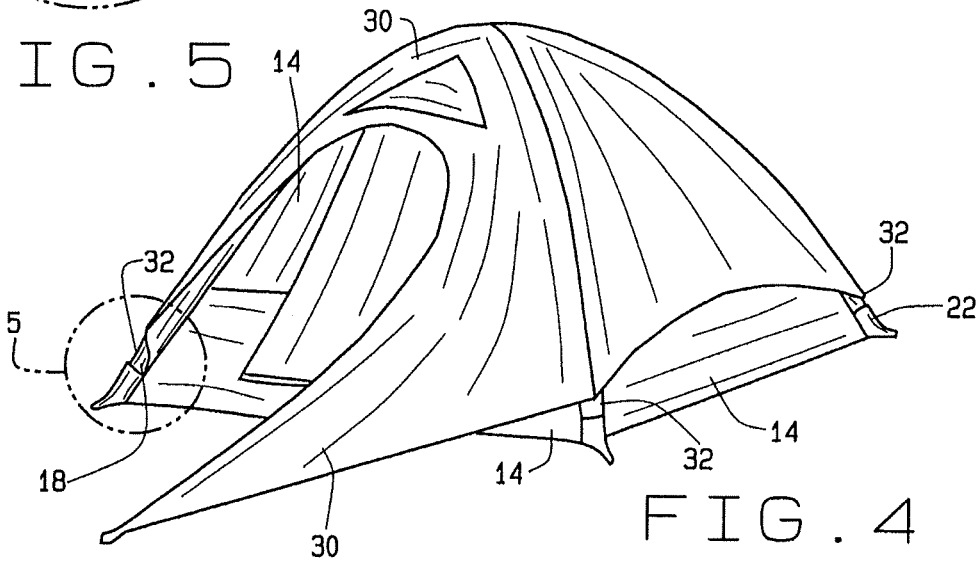
FIG. 4 is a view in perspective of the tent shown in FIGS. 1 and 2 with a weather cover in place according to one exemplary embodiment.

As shown in this example, the canopy 12 includes a plurality of securing sleeves 20, pockets 22, and/or loops 24 (shown in FIG. 2). Unlike many such shelters, shelter 10 does not include any stiff or rigid poles, but rather utilizes the inflatable supports 18 of the support assembly 16 for providing the significantly semi-rigid structure for supporting the canopy 12. The supports 18 are connected together at a connection point 26 such that they are pneumatically coupled or connected. The connection point can also define an apex 44 for the shelter 10. Air can be inserted and removed from all of the supports via a port 28. Generally, a single port 28 can be provided for inflating and deflating the support assembly 16 and each of the supports 18. However, in some embodiments more than one port 28 can be provided to expedite the deflation of the support assembly 16. Additionally, a second canopy 30 can be added such as a rain fly as shown in FIG. 4. The second canopy 30 can be attached to the supports 18, the support assembly 16 or to the canopy 12 via straps 32, ropes, strings, and or hook and loop ties.

Figure 6:
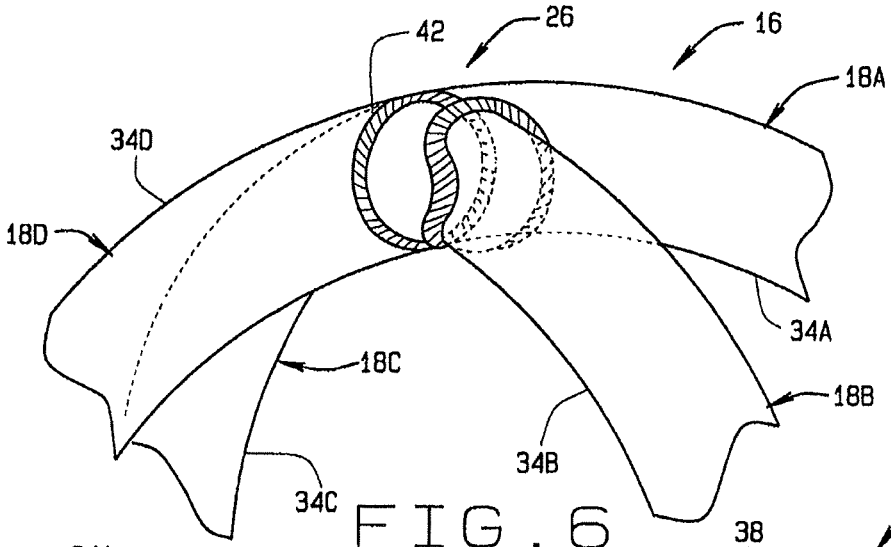
FIG. 6 is a view in perspective, partially broken away, illustrating a top junction of the support structure interconnecting multiple tubes according to one exemplary embodiment.
Figure 7:
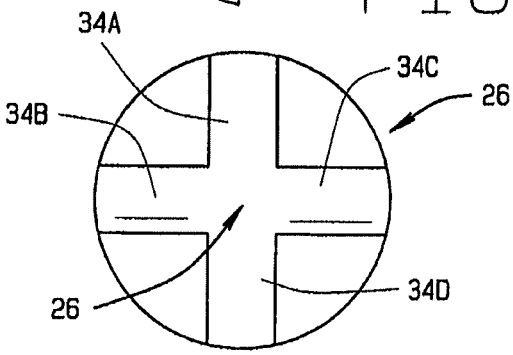
FIG. 7 is a top view, partially broken away, of one exemplary embodiment of the top junction of the support structure of FIG. 6.
Figure 8:
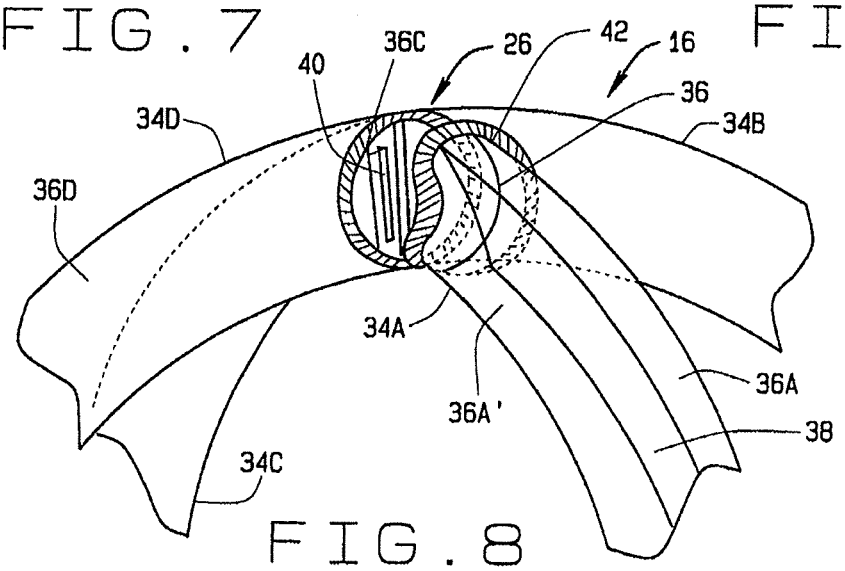
FIG. 8 is a top perspective view, partially broken away illustrating a top junction of the support structure interconnecting multiple tubes according to another exemplary embodiment.
Figure 10:
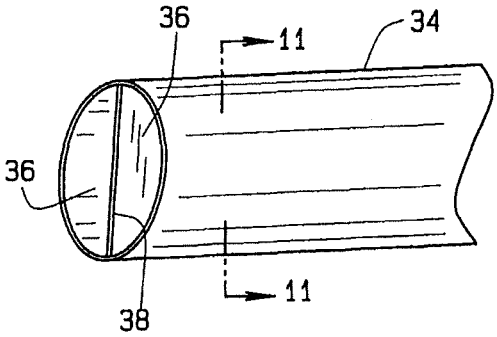
FIG. 10 is a view in perspective, partially broken away, showing the supporting tube structure in the associated tube support according to exemplary embodiments.
Figure 11:
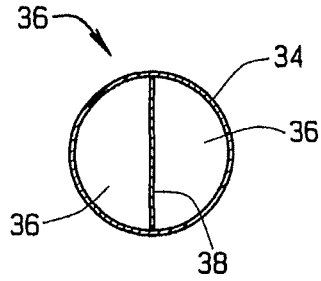
FIG. 11 is a view in perspective, partly broken away, taken along the line 11-11 of the exemplary embodiment of FIG. 10.

In some embodiments, as shown in FIGS. 6-8, the support assembly 16 includes a first inflatable support 18A having an elongated tube body 34 (shown as 34A) and can have one or more additional inflatable supports 18B, 18C, and 18D.

Figure 9:
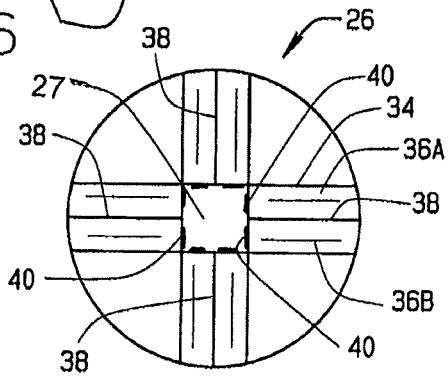
FIG. 9 is a top view, partially broken away, of one exemplary top junction of the support structure of FIG. 8.

As shown in FIGS. 8 and 9, in some embodiments each tube body 34 includes at least two separate longitudinal passages 36 (shown by way of example as 36A and 36A' in FIG. 8) pneumatically separated by one or more bladders 38, such as shown in FIGS. 8, 9, 10 and 11 as being a divider wall extending laterally between two opposing sides of the tube body 34). This is shown in more detail in FIGS. 10 and 11 with one bladder 38 forming two passages 36, by way of example.

Generally, the tube body 34 of each support 18 is connected to the tube body 34 of an adjacent support 18 such that they are pneumatically connected and such that each passage 36 of each body 34 is pneumatically connected. By being so connected, the port 28 can be associated with a single support 18 while still providing inflation and deflation to all supports 18 and all passages 36 therein of the support assembly 16.

Additionally, as shown in the exemplary embodiments of FIGS. 8 and 9, each passage 36 of the supports 18 can include a pneumatic valve mechanism 40 for restricting the flow of air received into the passage from exiting the passage without input from a user. Pneumatic valve mechanisms 40 are known in the art and can provide for a user activated one-way airflow. In this manner, each of the passages 36 can be isolated after inflation such that a leak or hole in the tube body 34 of one support 18 will only deflate a single passage 36 (such as 36A or 36A' as shown in FIG. 8). As such, the support assembly 16 is capable of continuing to support the canopy 12. The bladder 38 of each support 18 generally extends longitudinally within the tube body and the pneumatic valve mechanism 40 is positioned proximate to a connection between the first and second tube bodies.

Figure 17:
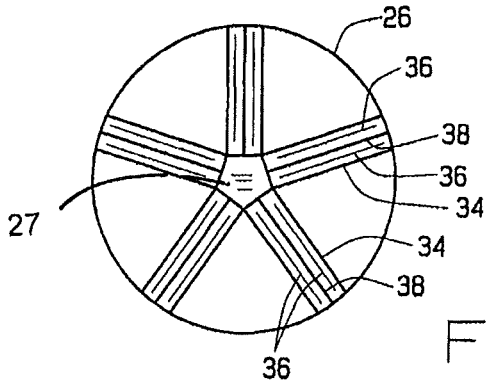
FIG. 17 is a top perspective view, partially broken away, illustrating one embodiment of the support structure of FIG. 15.

Generally, each tube body 34 is directly pneumatically connected to one or more other tube bodies 34 at a connecting point 26 without requiring an auxiliary tube or conduit extending there between provided by some prior implementation. Such a connection between the tube bodies 34 can be by any known method or technology but in some embodiments, includes a seam weld 42 having a seam extending circumferentially about the periphery of an end of each tube body, or at least a portion associated with the connection. The connecting point 26 can also be in the form of a manifold 27 (as shown in FIGS. 9 and 17) that is configured for pneumatically connecting each of the tube bodies 34 and each of the passages 36 of each tube body 34.

The interconnection between two or more tube bodies 34 can form the apex 44 (or vertex) of the support assembly 16 and the shelter 10.

Generally, each tube body 34 and each passage 36 of each tube body 34 is configured to receive and retain a relatively high air pressure within each passage 36 as received from port 28 and via the pneumatical connection between the various tube bodies 34 and passages 36. Such air pressure can be any air pressure sufficient to provide a semi-rigid structure for support the canopy 12. For example, this can be in the range of between about 10 to about 30 pounds per square inch inflated pressure.

The port 28 can be positioned anywhere. In one embodiment is can be located at a distal end of one of the tube bodies 34 from the point of interconnection 26 between two or more of the tube bodies 34 of the support assembly 16. However, it can also be located at the point of interconnection 26 or along a side of any of the tube bodies 34.

In some embodiments, a support structure includes two or more inflatable tubes that are interconnected so that all tubes are inflated simultaneously. When inflated, the tubes provided a significantly rigid structure for supporting an associated tent enclosure.

In some embodiments, a support structure for a tent includes a plurality of tubes attached to a single header. One of the tubes has a port or connection for inflating or forcing pressurized air into it, which results in all tubes being inflated simultaneously. When inflated, the tubes provide a significantly rigid structure from which the shelter or tent is suspended.

In some embodiments, a top junction is configured for joining a plurality of leg tubes together. One of the leg tubes includes the port or connection for inflating all of the legs of the tent.

The various tubes of the support structure can be inserted through a series of loops, or straps or sleeves and can be inserted into a pocket attached to the canopy or other structural material that can provide both easy insertion of the tubes through the loops and easy removal of the tubes should damage to the tubes supporting structure occur.

As noted, each of the tubes can include a divider wall bladder 38 internally of the individual tubes for providing rigidity in a variety of operating conditions.

As described herein, the inventor hereof has succeeded at designing an improved air inflation structure. The inventor has found that utilization of a single header having a plurality of tubes extending from the header, which are easily attachable to the fabric comprising of the tent enables a simplified structure, easy removal and replacement of tubes, should they become damaged, and easy inflation of the tubes themselves.

While this disclosure is described in particular detail with respect to a simplified construction for erecting a tent, those skilled in the art will recognize the wider explicability of the principals disclosed hereinafter.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A support assembly for a canopy of a shelter comprising:

a first inflatable support having an elongated tube body and defining two separate longitudinal passages pneumatically separated by a bladder defined by a divider wall extending laterally between two opposing sides of the tube body of the first inflatable support;

a second inflatable support having an elongated tube body and defining two separate longitudinal passages pneumatically separated by a bladder defined by a divider wall extending laterally between two opposing sides of the tube body of the second inflatable support, wherein the tube body of the second support is connected to the tube body of the first support and wherein each of the passages of the second support is pneumatically connected to each of the passages of the first support; and a port pneumatically coupled to one of the first and second supports, the port selectively passing air between an external pneumatic vessel and the support to which the port is coupled.

2. The assembly of claim 1 wherein each of the passages of the supports includes a one-way pneumatic valve mechanism for restricting the flow of air received into the passage from exiting the passage without input from a user.

3. The assembly of claim 2 wherein the bladder extends longitudinally within the tube and the pneumatic valve mechanism is positioned proximate to a connection between the first and second tube bodies.

4. The assembly of claim 1 wherein the first tube body is directly pneumatically connected to the second tube body and wherein there is a single port for the assembly, wherein the direct pneumatic connection is without an auxiliary tube or conduit extending between the first and second tube bodies.

5. The assembly of claim 1 wherein the first tube body is connected to the second tube body by a seam extending circumferentially about the peripheral of an end of each tube body.

6. The assembly of claim 1, further comprising a manifold pneumatically connecting each of the tube bodies and each of the passages of each tube body.

7. The assembly of claim 1, further comprising a third support having an elongated tube body and defining two separate longitudinal passages pneumatically separated by a bladder defined by a divider wall extending laterally between two opposing sides of the tube body of the first inflatable support, wherein the tube body of the third support is pneumatically connected to the tube bodies of the first and second support and wherein each of the passages of the third support is pneumatically connected to each of the passages of the first and second support.

8. The assembly of claim 7, further comprising a fourth support having an elongated tube body and defining two separate longitudinal passages pneumatically separated by a bladder defined by a divider wall extending laterally between two opposing sides of the tube body of the first inflatable support, wherein the tube body of the fourth support is pneumatically connected to the tube bodies of the first, second and third supports and wherein each of the passages of the fourth support is pneumatically connected to each of the passages of the first, second, and third supports, wherein each tube body of the first, second, third and fourth supports are connected to form a physical and pneumatic hub.

9. The assembly of claim 1 wherein each tube body and each passage of each tube receive and retain a relatively high air pressure within each passage, and wherein the relatively high air pressure includes air pressure in the range of between about 10 to about 30 pounds per square inch inflated pressure.

10. The assembly of claim 1 wherein the port is positioned at an end of one of the tube bodies that is distal from a point of interconnection between the first and second supports.

11. A shelter comprising:

a support assembly having a plurality of inflatable supports each having an elongated tube body and defining two separate longitudinal passages pneumatically separated by a bladder defined by a divider wall extending laterally between two opposing sides of each tube body of each inflatable support, wherein the tube bodies of each support is connected to the tube body of one or more of the other supports and wherein each of the passages of the each support is pneumatically connected to each of the passages of the other supports, and wherein the supports are spaced circumferentially apart as legs of the support assembly for forming a perimeter of the shelter, and a single port pneumatically coupled to only one of the supports that includes an air valve for connecting to an external air supply, the port passing air between an external pneumatic vessel and the support to which the port is coupled; and a canopy including a plurality of wall panels, the wall panels being suspended from the support assembly.

12. The shelter of claim 11 wherein the canopy includes at least one of a series of loops receiving and holding the supports of the support assembly and one or more sleeves receiving and holding the supports of the support assembly.

13. The shelter of claim 11 wherein the canopy is a first canopy, further comprising a second canopy positioned external to the first canopy and the support assembly, the second canopy including fasteners selectively securing the second canopy to at least one of the first canopy and the support assembly.

14. The shelter of claim 11 wherein each of the passages of the supports includes a pneumatic valve mechanism for restricting the flow of air received into the passage from exiting the passage without input from a user, and wherein the bladder extends longitudinally within the tube and the pneumatic valve mechanism is positioned proximate to a connection between the first and second tube bodies.

15. The shelter of claim 11 wherein each tube body is directly pneumatically connected to an adjacent tube body and is without an auxiliary tube or conduit extending between the two adjacent tube bodies.

16. The shelter of claim 11 wherein each tube body is connected to an adjacent tube body by a seam extending circumferentially about the peripheral of each connected adjacent tube body.

17. The shelter of claim 11, further comprising a manifold pneumatically connecting each of the tube bodies and each of the passages of each tube body.

18. The shelter of claim 11 wherein each tube body and each passage of each tube body of the support structure are configured to receive and retain a relatively high air pressure within each passage, the relatively high air pressure including air pressure in the range of between about 10 to about 30 pounds per square inch inflated pressure.

19. The shelter of claim 11 wherein the port is positioned at a distal end of one of the tube bodies from a point of interconnection between two or more of the tube bodies of the support assembly.

20. The assembly of claim 1 wherein the divider wall defining the bladder of the first inflatable support is formed from the same material as forming the first tube body and wherein the divider wall defining the bladder of the second inflatable support is formed from the same material as forming the second tube body.

21. The shelter assembly of claim 11 wherein the divider wall defining the bladder of the inflatable supports for the support assembly are formed from the same material as forming each tube body.

* * * * *